United States Patent [19]

Dürkop et al.

[11] Patent Number: 4,927,383

[45] Date of Patent: May 22, 1990

[54] ELECTRICAL PLUG CONNECTOR

[75] Inventors: Willi Dürkop, Reinheim; Wolfgang Scheffner, Roedermark-deutsche Staatsbürger, both of Fed. Rep. of Germany

[73] Assignee: C. A. Weidmüller GmbH & Co., Fed. Rep. of Germany

[21] Appl. No.: 381,381

[22] Filed: Jul. 18, 1989

[30] Foreign Application Priority Data

Aug. 4, 1988 [EP] European Pat. Off. ..... 88112662.7

[51] Int. Cl.[5] ..... H01R 3/00

[52] U.S. Cl. ..... 439/491; 40/299

[58] Field of Search ..... 439/488, 491, 709, 718; 174/112; 200/308, 309; 40/299

[56] References Cited

U.S. PATENT DOCUMENTS 3,665,377 5/1972 MacKenzie, Jr. ..... 439/719
4,258,487 3/1981 Hohorst ..... 40/299
4,550,964 11/1985 Donais et al. ..... 439/491

FOREIGN PATENT DOCUMENTS 0230537 8/1987 European Pat. Off. .
3608535 5/1987 Fed. Rep. of Germany .

*Primary Examiner*—Eugene F. Desmond
*Assistant Examiner*—Walter G. Hanchuk
*Attorney, Agent, or Firm*—Laubscher, Presta & Laubscher

[57] ABSTRACT

A heavy-duty electrical plug connector is characterized by a label plate slidably connected with the connector housing for movement between retracted and extended positions. A label containing information designating the poles of the plug connector is provided on the plate. For wiring the connector, the plate is pulled to its extended or reading position wherein the labelled designations of the poles of the connector are visible. After wiring, the plate is slid beneath the housing to its retracted position where it takes up little space and where it does not interfere with wiring work on other connectors.

6 Claims, 3 Drawing Sheets

ELECTRICAL PLUG CONNECTOR

BACKGROUND OF THE INVENTION

The present invention relates to a heavy-duty electrical plug connector including a retractable label plate which includes information designating the various poles of the connector.

BRIEF DESCRIPTION OF THE PRIOR ART

Heavy-duty electrical plug connectors, which also include high-pole plug connectors and feed-through bushing connectors, as shown by German Industrial Standard DIN 43652, are characterized by a relatively large contact density and a large number of poles. With these connectors, there is a requirement for designating or marking the poles of the connector so that the user can properly connect electrical wires therewith. The designations must be as comprehensive as possible.

Currently, pole designation is provided by way of a disk-like accessory which protrudes from the plug connector, the pole designations being provided on the accessory. Other types of pole designations are provided on the sliding lids of cable ducts as shown in EP-Al-0230537.

The primary drawback of these prior devices is that they require a large amount of space on the plug connector for pole designation. The considerably increased space requirement is particularly disadvantageous since in typical electrical circuit arrangements, a plurality of plug connectors must be arranged in rows located behind each other with the plug connectors in each case being lined up next to each other. The voluminous structure of the plug connectors in a row thus interferes with the wiring of plug connectors in other rows and frequently requires a wide interval between rows which increases the overall dimensions of the circuit.

The present invention was developed in order to overcome these and other drawbacks of the prior devices by providing a heavy-duty electrical plug connector which provides comprehensive pole designations or labelling without requiring a lot of space.

SUMMARY OF THE INVENTION

Accordingly, it is a primary object of the present invention to provide an electrical plug connector including a housing and a labelled plate slidably connected with the housing for movement between a retracted position wherein the plate is arranged beneath the housing and an extended reading position wherein the plate is arranged beyond the housing. The invention is based on the realization that pole labelling is basically needed only during wiring of the plug connector. In this case, the plate can be pulled out into its extended position, wherein labels on the plate bearing information designating the poles of the connector can be read. After completing wiring of the connector, the plate is pushed under the plug connector housing out of view. The arrangement according to the invention thus requires only a very small space. The plate protrudes from the connector housing only when the connector is being wired which does not create any disturbance in terms of space. During wiring of other plug connectors in an adjacent rear row, the plates of the forward row of connectors are retracted and thus do not interfere.

The plates can include any type of labelling. For example, stick-on labels may be attached to the surface of the plate. Alternatively, a writing surface can be provided on the plate. Furthermore, labelling information may be directly printed on the plate.

According to a more specific object of the invention, the connector housing includes a guide such as a pair of grooves on the side edges thereof for guiding the plate relative to the housing during sliding movement between the retracted and extended positions. Moreover, the plate is provided with a stop which engages spaced recesses in the groove of the housing to stop the plate in various positions intermediate the retracted and extended positions. This enables the plate to be extracted to a limited extent to allow the user to read precisely that row of designations directly behind the corresponding edge of the plug connector. In other words, the plate can be positioned to read the row of labeled pole designations which are to be wired at precisely that moment.

According to a further object of the invention, the plate is extensible beyond the length of the plate. In one embodiment, the plate includes telescoping sections. In another embodiment, the plate comprises a pair of sections, one of which folds on top of the other. With the extensible plate, the user is provided with more comprehensive pole designation information without interfering with the wiring operation.

BRIEF DESCRIPTION OF THE FIGURES

Other objects and advantages of the invention will become apparent from a study of the following specification, when viewed in the light of the accompanying drawing, in which.

DETAILED DESCRIPTION

Figure 1:
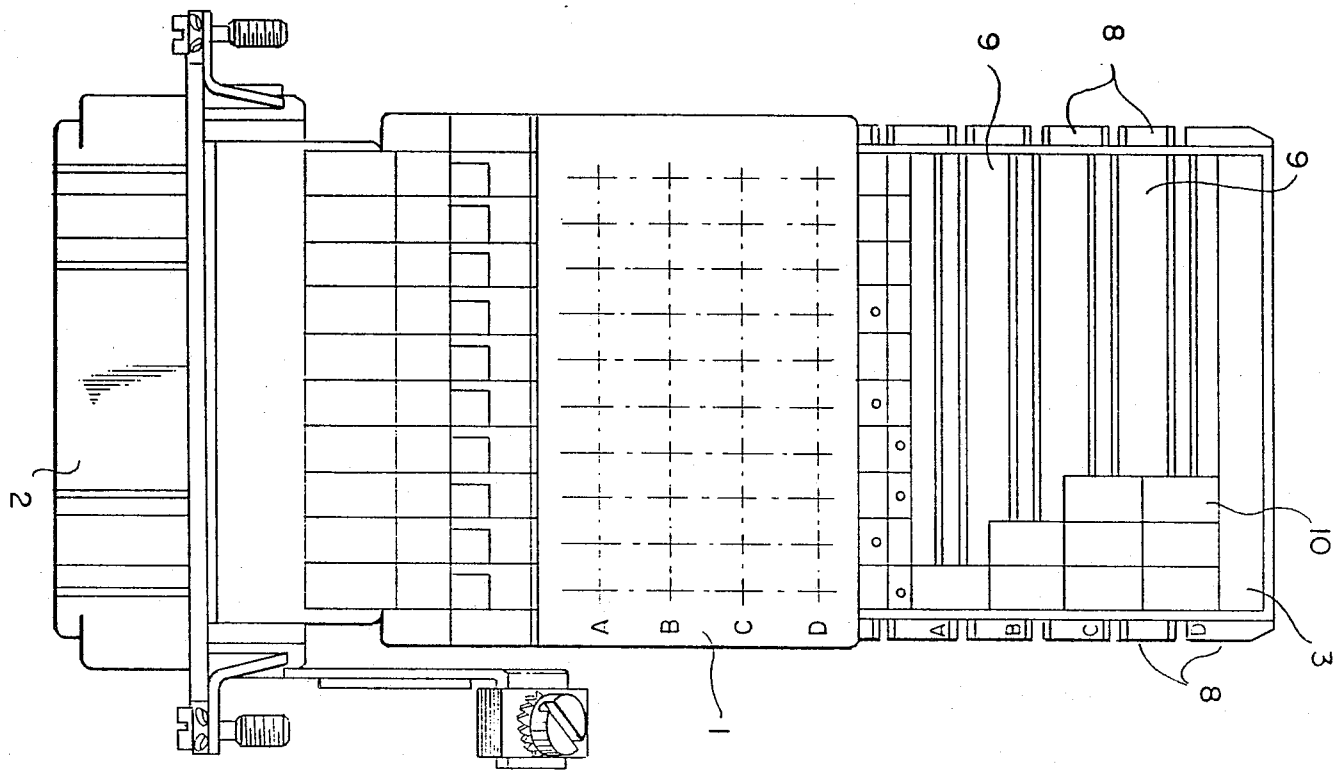
FIG. 1 is a top view of the electrical plug connector of the present invention with the slide plate in an extended position.
Figure 2:
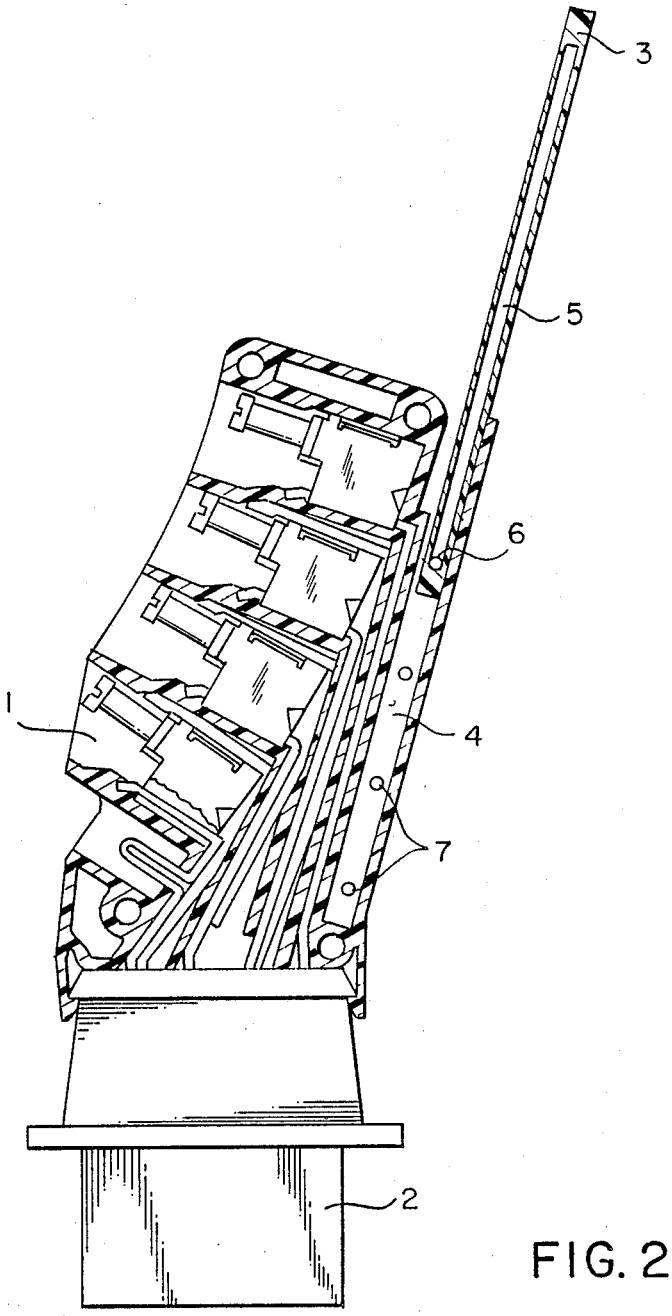
FIG. 2 is a partial sectional side view of the connector of FIG. 1.

Referring first to FIGS. 1 and 2, the heavy-duty electrical plug connector according to the invention will be described. The connector is preferably of the feed-through bushing type and includes a housing 1 which is connected with a socket or plug 2. The housing contains a plurality of connections that are indicated in FIG. 1 by dot and dash crosses.

In the example shown, there are provided four rows of connections labelled A, B, C, and D with ten connections in each row for a total of forty connections. Thus for the connector of FIG. 1 there is a need for a corresponding designation of forty locations for correct wiring to the poles or connections of the connector.

In order to provide a comprehensive designation of these connections for wiring, there is provided a slide plate 3 on which labelling may be provided. The plate 3 is slidably connected with the housing 1 for movement between a retracted position wherein the plate is arranged within the housing and an extended position (as shown in FIG. 1) wherein the plate is arranged beyond the housing. The labelling on the plate designates the poles of the connector and is visible when the plate is extended and is obscured from view when the plate is retracted.

Accordingly, the plate 3 is pulled out to its extended reading position when needed during wiring on the plug connector. After wiring is completed, the plate is pushed back under the connector housing 1, whereby it can not interfere with wiring work being performed on other plug connectors, especially plug connectors that lie in the rear rows of the electrical circuit. Thus in such a circuit, the intervals between the rows of the plug connectors are kept to a minimum.

As shown in FIG. 2, the housing 1 includes grooves 4 which serve to guide the slide plate 3 as it moves between its extended and retracted positions. More particularly, the plate 3 includes guide bars 5 at each side edge thereof which engage grooves 4 on the connector. The lower end of the bars 5 include a projection 6 which is adapted to be received in recesses 7 contained in the bottom of the grooves. The projections and recesses cooperate and serve as a stopping mechanism to stop sliding movement of the plate relative to the housing 1 in various positions between the extended and retracted positions of the plate. The stopping mechanism is also operable to retain the plate in its fully retracted position.

The plate is reversibly mounted in the grooves 4 at the rear of the connector housing. The grooves are arranged adjacent the side edges of the housing and each contain recesses 7 for receiving the projections 6 at the base of the guide bars in accordance with the orientation of the plate.

In lieu of the projections 6 and recesses 7 of the stopping mechanism of FIG. 2, an alternative stopping mechanism can be provided as shown in FIG. 1. In this embodiment, the guide bar is divided into segments 8 defining therebetween a small clearance at desired locations. A protrusion (not shown) is provided in the grooves 4 and snaps into the clearance to stop the plate in a particular position.

The labelling for the slide plate 3 can be of any design as determined by the particular requirements of the connector. In the embodiment of FIG. 1, the plate 3 includes a plurality of strips 9 defining clear spaces between the strips into which small pins of labels 10 can be inserted. Alternatively (or in conjunction therewith), conventional plug receptacles for small labels having plug prongs can be provided. Adhesive strips may be attached to the plate for adhering foils with pole designations thereon, or the designation information may be printed directly onto the plate surface.

The aforementioned stopping mechanisms enable the slide plate 3 to be locked or snapped into any position between its fully retracted and extended positions. This facilitates reading of the pole designation information provided thereon to the extent that the user can extract the slide plate incrementally during wiring of the connector so that the pole designations for the row next in line for wiring will become visible at the upper edge of the connector housing 1.

Figure 3:
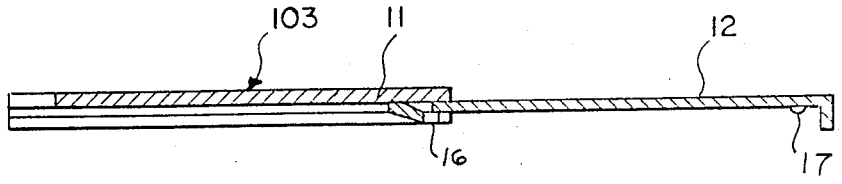
FIG. 3 is a sectional side view of a telescoping slide plate according to the invention.

Referring now to FIG. 3, an alternate embodiment of the slide plate 103 will be described. In this embodiment, the plate 103 can be extended beyond its length behind and past the connector housing. The plate is formed in a telescoping fashion and includes a base section 11 having a customary length corresponding to the length of the guide grooves and a telescoping section 12 which is guided within the base section. A locking arrangement including an aperture 16 in the base section 11 for receiving protection 17 on the telescoping section 12 is provided to lock the sections together when the plate 103 is in the retracted position.

Figure 4:
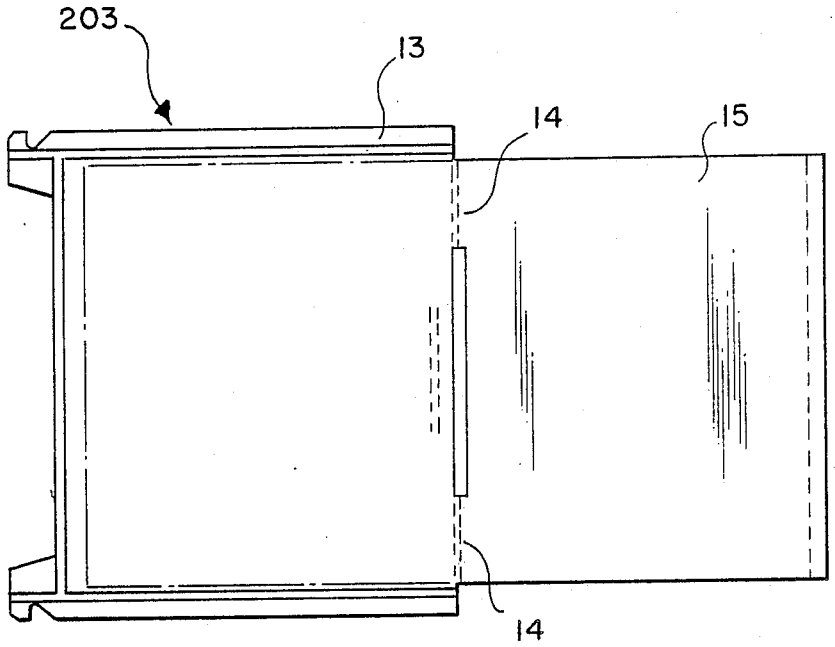
FIG. 4 is a top view of a foldable slide plate according to the invention.

FIG. 4 illustrates a further embodiment of an extensible slide plate 203. In this embodiment, a folding section 15 is connected with a base section 13 via hinges 14. When the plate 203 is to be retracted, the section 15 is folded onto the section 13 and locked in place, following which the plate is slid to its retracted position.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. An electrical plug connector, comprising
(a) a housing; and
(b) a plate slidably connected with said housing for movement between a retracted position wherein said plate is arranged within said housing and an extended position wherein said plate is arranged beyond said housing, said plate including a label for designating the poles of the connector, said label being visible when said plate is in the extended position and said label and said plate being obscured from view by said housing when said plate is in the retracted position.

2. Apparatus as defined in claim 1, wherein said housing includes means for guiding said plate during movement between its retracted and extended positions, said plate and said guide means including means for stopping said plate at positions between the retracted and extended positions.

3. Apparatus as defined in claim 2, wherein said plate is reversibly connected with said housing, whereby said label may be positioned on opposite sides relative to said housing.

4. Apparatus as defined in claim 2, wherein said plate includes extension means which may be extended beyond the length of said plate.

5. Apparatus as defined in claim 4, wherein said extension means comprises a telescoping portion of said plate.

6. Apparatus as defined in claim 4, wherein said plate comprises two sections, said extension means comprising one of said sections which is adapted for folding on top of the other.

* * * * *